US007731048B2

(12) United States Patent
Teixeira Alvares et al.

(10) Patent No.: US 7,731,048 B2
(45) Date of Patent: Jun. 8, 2010

(54) CLOSURE ASSEMBLY WITH BREAKAWAY SEALING PORTION WITH GRIPPING TAB

(75) Inventors: Antonio Carlos Teixeira Alvares, Sao Paulo-SP (BR); Antonio Roberto Sene, Sao Paulo-SP (BR)

(73) Assignee: Brasilata S/A Embalagens Metalicas, Sao Paulo-Sp (BR)

( * ) Notice: Subject to any disclaimer, the term of this patent is extended or adjusted under 35 U.S.C. 154(b) by 1042 days.

(21) Appl. No.: 10/504,515

(22) PCT Filed: Mar. 6, 2003

(86) PCT No.: PCT/BR03/00030

§ 371 (c)(1),
(2), (4) Date: Nov. 24, 2004

(87) PCT Pub. No.: WO03/074381

PCT Pub. Date: Sep. 12, 2003

(65) Prior Publication Data

US 2005/0092751 A1 May 5, 2005

(30) Foreign Application Priority Data

Mar. 7, 2002 (BR) ..... 0201981
Sep. 6, 2002 (BR) ..... 0203950

(51) Int. Cl.
*B65D 17/34* (2006.01)
*B65D 17/40* (2006.01)
*B65D 51/20* (2006.01)

(52) U.S. Cl. ..... 220/270; 220/276; 220/257.1; 220/257.2; 220/258.1; 220/258.2; 220/319; 215/255; 215/256

(58) Field of Classification Search ..... 220/257.1, 220/257.2, 268–270, 319, 265, 266, 541.6, 220/546; 222/153.07, 541.6, 541.9, 546; 215/253–256; 229/141, 243, 244
See application file for complete search history.

(56) References Cited

U.S. PATENT DOCUMENTS 2,191,447 A * 2/1940 Beardsley ..... 215/248

(Continued)

FOREIGN PATENT DOCUMENTS

DE 3149 663 A1 10/1982

(Continued)

*Primary Examiner*—Anthony Stashick
*Assistant Examiner*—Ned A Walker
(74) *Attorney, Agent, or Firm*—Darby & Darby P.C.

(57) ABSTRACT

A plastic lid for a can of the type comprising a tubular body (10) having an upper end (13) for the seating of the lid (20) comprising a sealing portion (21), removably seated on the tubular body (10) and provided with an upper edge (21*b*), a seal portion (25), to be ruptured upon the first opening of the lid (20), having an upper ring (25*b*) which is incorporated to a lower skirt (25*a*), said upper ring (25*b*) and said lower skirt (25*a*) being respectively seated onto and around part of the upper end (13), said upper ring (25*b*) being incorporated through radial bridges (26), to said upper edge (21*b*), the seal portion (25) presenting an interruption (25*c*) extending through the width of the upper ring (25*b*) and through at least part of the height of the lower skirt (25*a*). The sealing portion (21) incorporates a gripping tab (27) which is manually operable only when part of the seal portion (25) is ruptured.

17 Claims, 8 Drawing Sheets

U.S. PATENT DOCUMENTS 2,629,512 A * 2/1953 Quillinan ..... 220/270
3,159,303 A * 12/1964 Betner ..... 220/270
3,642,161 A * 2/1972 Stroud ..... 215/213
3,684,124 A * 8/1972 Song ..... 220/270
3,690,499 A * 9/1972 Westfall et al. ..... 215/253
3,773,207 A 11/1973 Dokoupil et al.
4,006,839 A 2/1977 Thiel et al.
4,087,018 A * 5/1978 Tebbutt ..... 220/257.2
4,106,653 A * 8/1978 Martinelli ..... 215/256
4,117,946 A 10/1978 Kessler
4,146,148 A * 3/1979 Dwinell et al. ..... 220/270
4,184,605 A * 1/1980 Hanson ..... 220/269
4,244,479 A * 1/1981 Smalley ..... 215/256
4,360,121 A * 11/1982 Helms ..... 220/270
4,361,250 A * 11/1982 Foster ..... 220/266
4,413,742 A * 11/1983 Sandhaus ..... 215/216
4,437,593 A * 3/1984 Bullock, III ..... 222/153.07
4,522,308 A * 6/1985 Sullivan ..... 215/253
4,664,288 A * 5/1987 Pereira et al. ..... 220/203.09
4,693,390 A * 9/1987 Hekal ..... 220/270
4,721,210 A * 1/1988 Lawrence et al. ..... 206/459.1
4,724,978 A * 2/1988 Cleevely et al. ..... 220/258.2
4,730,745 A * 3/1988 Perry ..... 215/230
4,732,293 A * 3/1988 Landis ..... 220/276
4,752,013 A * 6/1988 Miller et al. ..... 215/216
4,752,014 A * 6/1988 House et al. ..... 215/216
4,787,530 A * 11/1988 Edwards ..... 220/266
4,948,002 A * 8/1990 Thornock et al. ..... 215/221
4,966,292 A * 10/1990 Marino ..... 215/256
4,966,294 A * 10/1990 Mack et al. ..... 220/266
5,002,223 A * 3/1991 Bolte et al. ..... 229/123.2
5,020,686 A * 6/1991 Dutt ..... 220/276
5,042,680 A * 8/1991 Argudo et al. ..... 220/276
5,069,345 A * 12/1991 Irwin ..... 220/270
5,129,531 A * 7/1992 Beck et al. ..... 215/256
5,143,241 A * 9/1992 Szymanski ..... 220/270
5,284,265 A * 2/1994 Crisci ..... 215/256
5,326,022 A * 7/1994 Green ..... 229/120
5,538,154 A * 7/1996 Von Holdt ..... 220/277
5,617,968 A 4/1997 Luburic
5,671,853 A * 9/1997 Herr ..... 215/216
5,706,963 A * 1/1998 Gargione ..... 215/219
5,722,546 A * 3/1998 Briere ..... 215/216
5,725,146 A * 3/1998 Luberto ..... 229/120
5,740,933 A * 4/1998 Conti et al. ..... 215/256
5,865,330 A * 2/1999 Buono ..... 215/216
5,868,307 A * 2/1999 Calvert ..... 229/125.35
5,899,352 A * 5/1999 Guarda et al. ..... 220/254.1
5,979,680 A * 11/1999 Farside ..... 215/216
5,979,681 A * 11/1999 Varlet et al. ..... 215/216
5,996,833 A * 12/1999 Lencioni et al. ..... 220/257.2
D421,909 S * 3/2000 Opresco ..... D9/443
6,036,036 A * 3/2000 Bilani et al. ..... 215/216
6,105,817 A * 8/2000 Ponton ..... 220/784
6,196,450 B1 * 3/2001 Varadarajan et al. ..... 229/123.2
6,257,435 B1 * 7/2001 Chedister et al. ..... 220/276
6,612,450 B1 * 9/2003 Buono ..... 215/228
6,799,692 B2 * 10/2004 Teixeira Alvares et al. ..... 220/254.1
6,854,616 B2 * 2/2005 Steffan ..... 220/270
2002/0104852 A1 * 8/2002 Staniszewski et al. .. 222/153.07
2003/0089715 A1 * 5/2003 Teixeira Alvares et al. .. 220/276
2003/0201266 A1 * 10/2003 Steffan ..... 220/258.2
2007/0090111 A1 * 4/2007 Alvares et al. ..... 220/257.2
2007/0108210 A1 * 5/2007 Alvares et al. ..... 220/270

FOREIGN PATENT DOCUMENTS

FR 2 727 387 A1 5/1996
GB 2 305 415 A1 4/1997
WO WO-00/58171 A1 10/2000

* cited by examiner

CLOSURE ASSEMBLY WITH BREAKAWAY SEALING PORTION WITH GRIPPING TAB

CROSS-REFERENCE TO PRIOR APPLICATIONS

This is a U.S. National Phase application under 35 U.S.C. §371 of International Patent Application No. PCT/BR03/00030 filed Mar. 6, 2003, and claims the benefit of Brazilian Patent Application Nos. PI 0201981-7 filed Mar. 7, 2002 and PI 0203950-8 filed Sep. 6, 2002. The International Application was published in English on Sep. 12, 2003 as WO 2003/074381 A1 under PCT Article 21(2).

FIELD OF THE INVENTION

The present invention refers to a plastic lid for the closure of a can made of a metallic sheet and of the type comprising a tubular body, with the lower edge affixing or incorporating a bottom wall and with the upper edge carrying, directly by means of a deformed portion of the tubular body or by means of an annular upper wall portion that can take the form of a structural ring, a seat for the seating and retention of the press-fittable lid. Particularly, the invention refers to the provision of a plastic lid for a can of the type considered above which is used for containing products of progressive consumption, such as certain food products.

BACKGROUND OF THE INVENTION

Determined products, such as certain food products, must be submitted to a hermetic storage and provided with a clear visual indication to the consumer that the container in which they are presented in the market has not been violated. Since many of these products are of progressive consumption, it is indispensable that after the first opening of the container, the lid which gives access to the inside of the can may be reclosed as many times as necessary during the progressive consumption of the stored product, in order to guarantee the hermeticity of the reclosed can and protect the remaining portion of the content thereof.

There are well known from the prior art the cans with a press-fit lid, in which the latter is press fitted in a peripheral structural ring, which is internal to the upper edge of the body of the can and which is hermetically double seamed to said upper edge. The hermeticity of the content is guaranteed in this type of construction by the fitting of the lid in the seat for the seating and retention thereof, which can be provided in the structural ring that defines the annular upper wall of the can, or in the tubular body of the latter.

In this type of closure, the tamper evident seal, which also guarantees the tightness, is normally defined by an aluminum metallic sheet, which is peripherally double seamed to the upper edge of the body of the can jointly with the structural ring. This inner seal is only visible when the lid is removed and it also requires the use of an instrument for cutting it peripherally, which invariably leaves cutting edges close to the upper opening of the can, causing frequent accidents with wounds in the user's fingers. Besides the inconveniences mentioned above, these known press-fit lids require the use of an instrument, in the form of a lever, for allowing the user to remove the lid from its seat defined in the structural ring. It is not possible for the user to remove this type of lid by using his hands only.

It is also known from the Brazilian patent application PI 0003727-3 a solution in which the plastic lid comprises a sealing portion, which is removably seated and retained in the seat, and a pair of generally semi-annular handles disposed around an upper edge of the sealing portion and having ends incorporated to the latter. The handles can be medianly displaced, from an inoperative position, coplanar to said upper edge, to a raised operative position, after rupturing the breakable means that connect the median regions of the handles to the sealing portion of the plastic lid. In this prior art construction, the plastic lid further incorporates a manually breakable seal strip, provided around the upper end of the tubular body and presenting a lower portion, which is seated and locked under the double seam of the annular upper wall, and an upper portion connected to the handles and to the sealing portion by breakable connecting means.

While it eliminates the deficiencies of the prior lids for cans containing products of progressive consumption, this prior solution of the same applicant still presents some inconveniences. One of said inconveniences relates to the questionable reliability of the retention of the seal strip, as it can be removed if carefully forced upwardly, sliding out from the upper double seam of the can.

Another inconvenience of said prior art lid results from the fact that the opening thereof, by axially pulling it by means of the opposite handles, is abrupt, provoking an undue discharge of the stored product when the lid is removed.

Two more aspects that can be improved are related to the facility with which the handles are accessed for extracting the lid, and to the permanence of the seal strip around the upper edge of the tubular body of the can, usually requiring the application of a cutting instrument for removing it.

OBJECTS OF THE INVENTION

It is a generic object of the present invention to provide a reclosable plastic lid for a can of the type considered herein, which presents a simple construction and reduced cost, incorporating means for facilitating the opening thereof and also a reliable seal of prompt visual indication of violation.

It is a further object of the present invention to provide a plastic lid such as defined above, which can be safely and easily handled by the consumer.

SUMMARY OF THE INVENTION

These and other objects and advantages of the present invention are achieved by providing a plastic lid for a can of the type comprising a tubular body having a lower end and an upper end carrying a seat for the hermetic seating of the lid.

According to the invention, the lid comprises, in a single piece: a sealing portion, which is removably seated and retained in the seat and provided with an upper edge projecting radially and outwardly from the seat; a seal portion having a lower skirt to be seated around part of the upper end of the tubular body, and an upper ring seated onto part of the upper end of the tubular body and being incorporated, externally, to the lower skirt and, internally and through radial bridges, to the upper edge of the sealing portion, the seal portion presenting, in its circumferential extension, an interruption, extending through the width of the upper ring and through at least part of the height of the lower skirt, the sealing portion incorporating a gripping tab projecting radially outwardly and axially downwardly, through said interruption of the seal portion, said gripping tab being manually operable only when part of the seal portion is ruptured, said radial bridges being ruptured when submitted to a certain pulling force for separating the seal portion from the sealing portion, when the lid is opened for the first time.

BRIEF DESCRIPTION OF THE DRAWINGS

The invention will be described below, with reference to the appended drawings, in which.

DESCRIPTION OF THE ILLUSTRATES EMBODIMENTS

Figure 1:
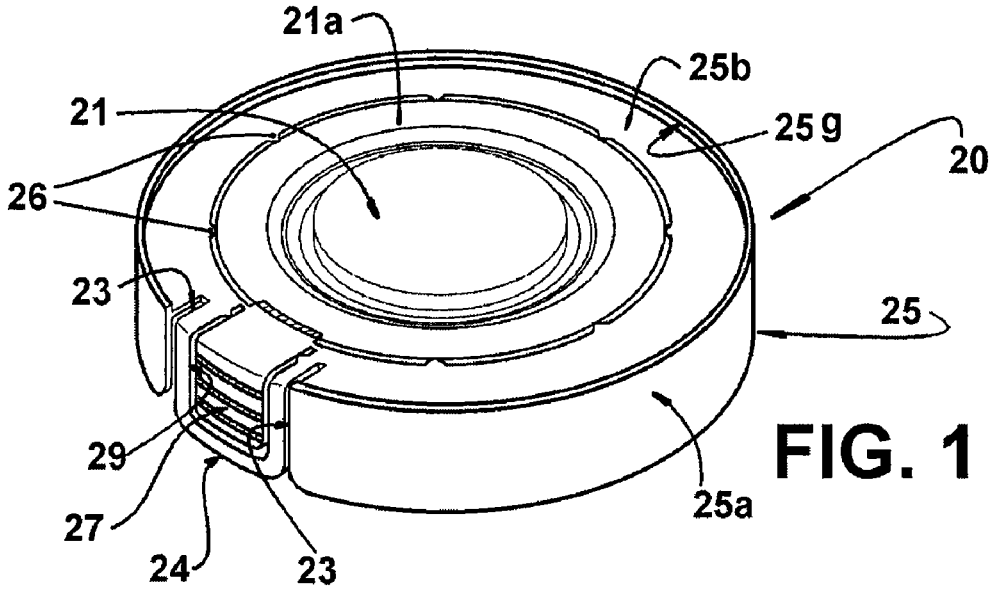
FIG. 1 is a perspective view of a plastic lid constructed according to a first embodiment of the present invention, incorporating a seal portion.
Figure 2:
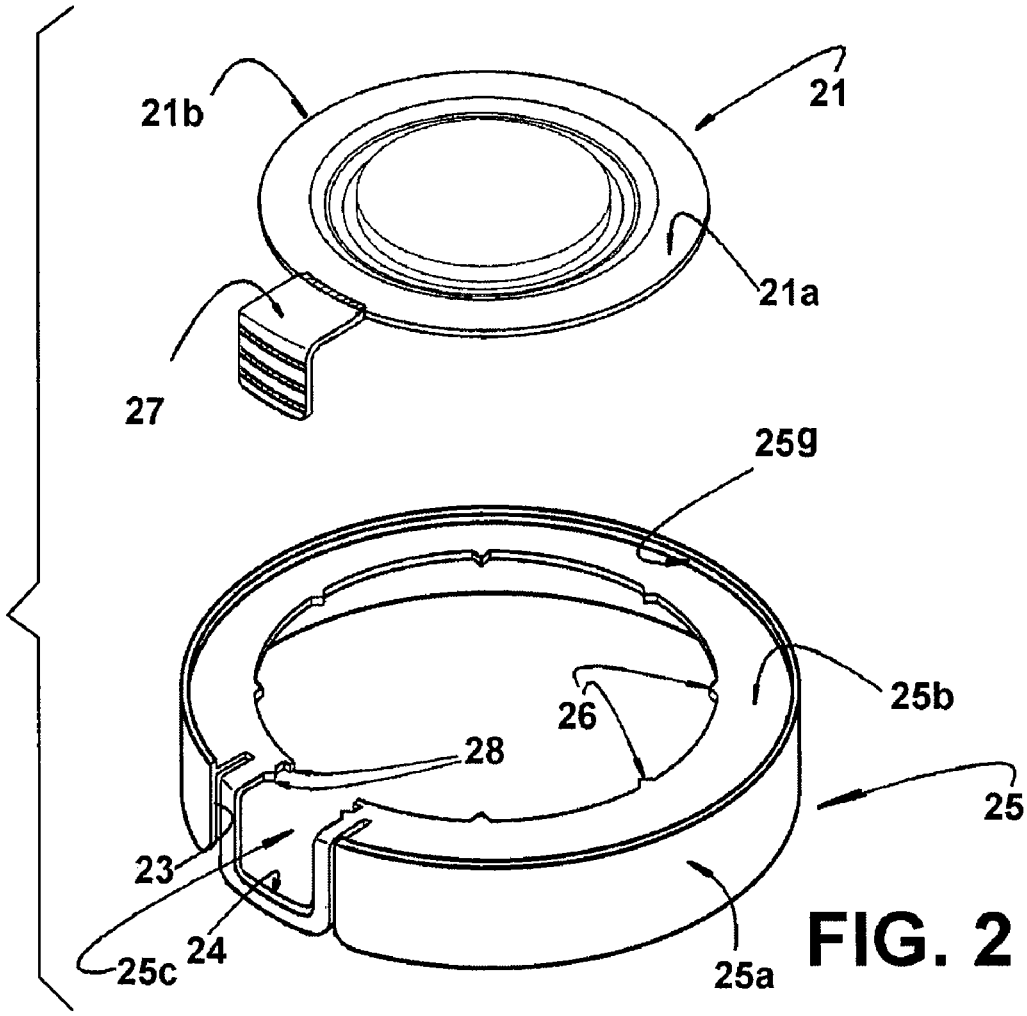
FIG. 2 is an exploded perspective view of the lid of FIG. 1, after the seal portion has been ruptured.
Figure 3:
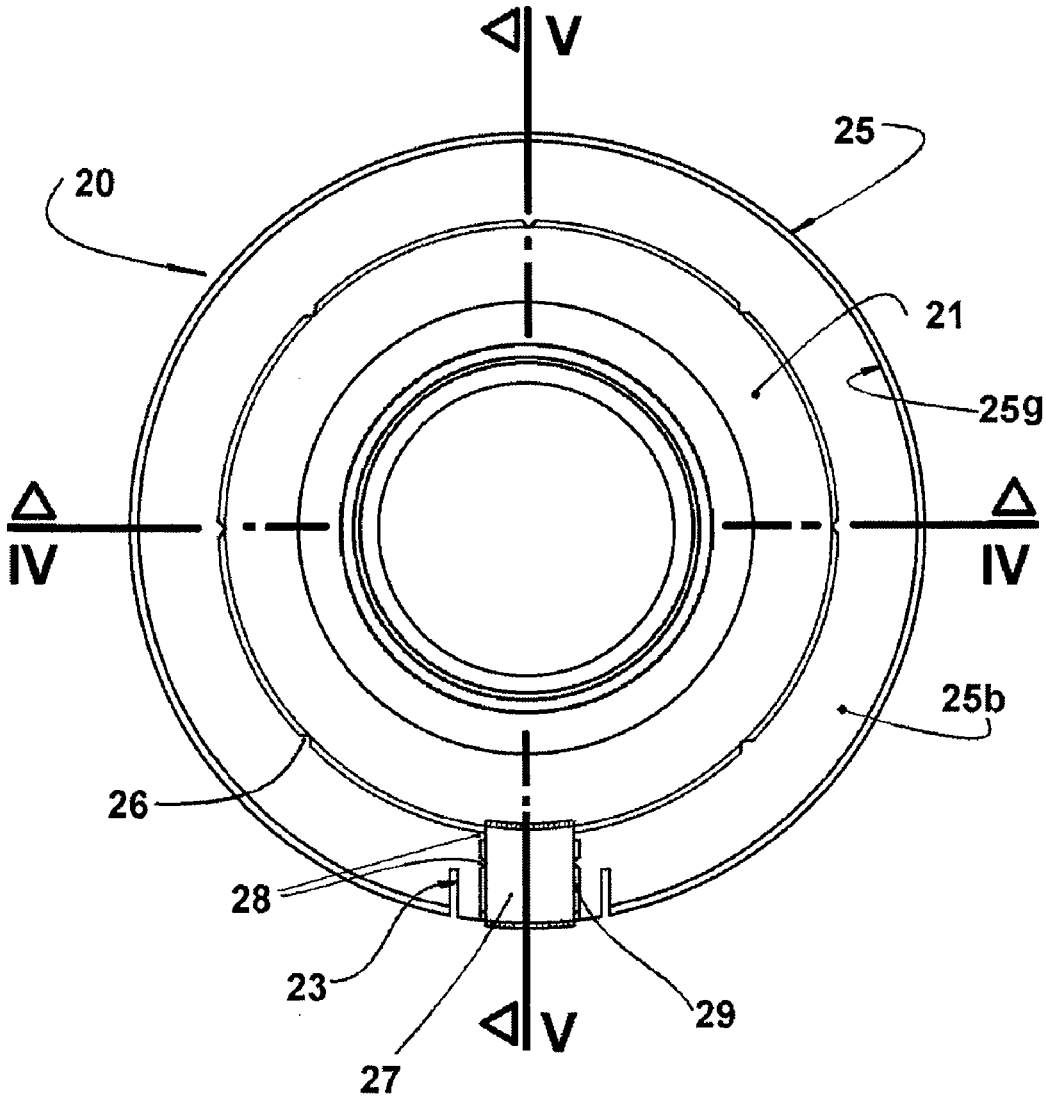
FIG. 3 is a top plan view of the plastic lid illustrated in FIG. 1.
Figure 4:
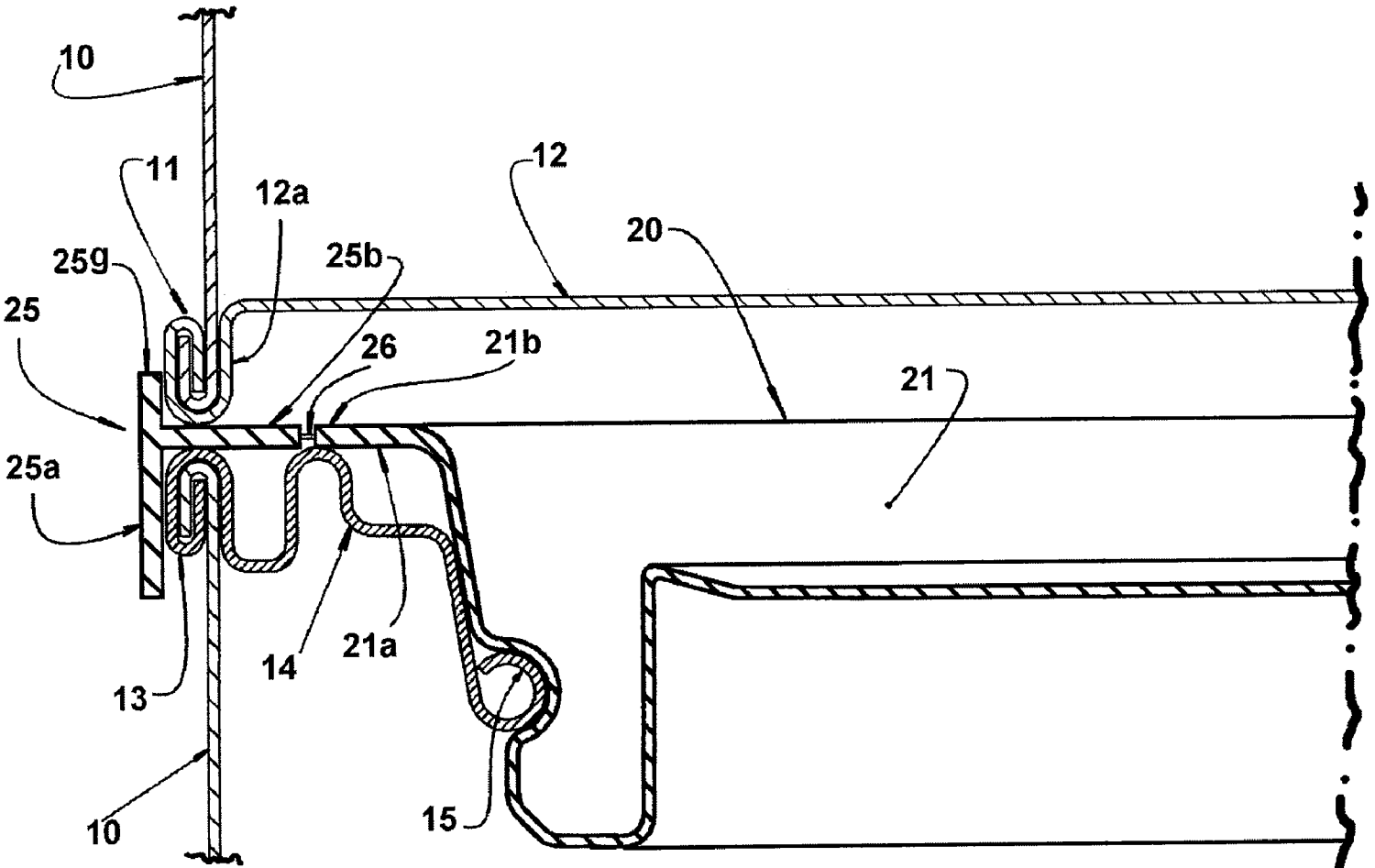
FIG. 4 is a partial diametrical cross-sectional view of the lid illustrated in FIGS. 1-3 when mounted to the upper end of a can, said view being taken according to line IV-IV of FIG. 3.
Figure 5:
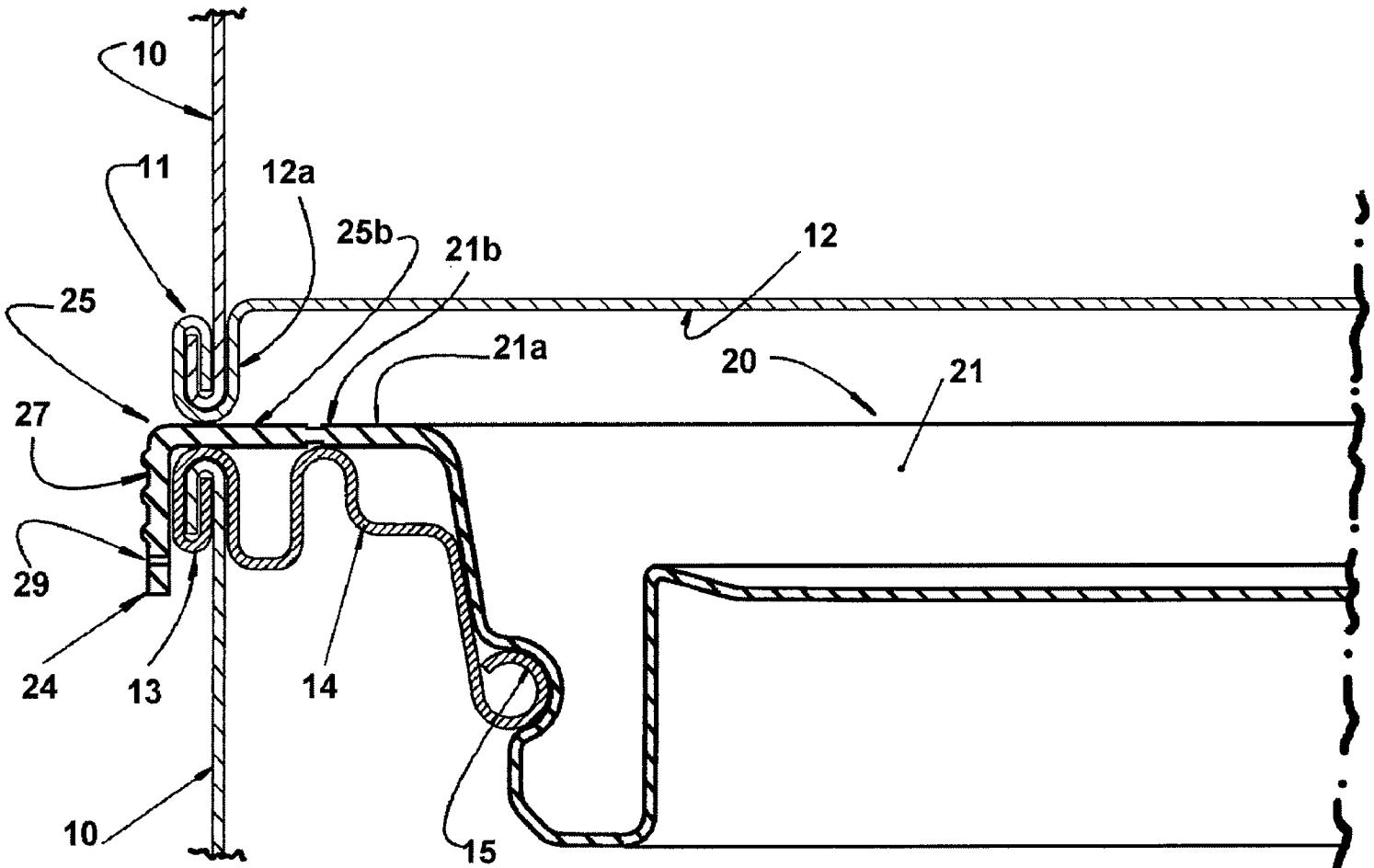
FIG. 5 is a similar view to that of FIG. 4, but taken according to line V-V in FIG. 3.
Figure 6:
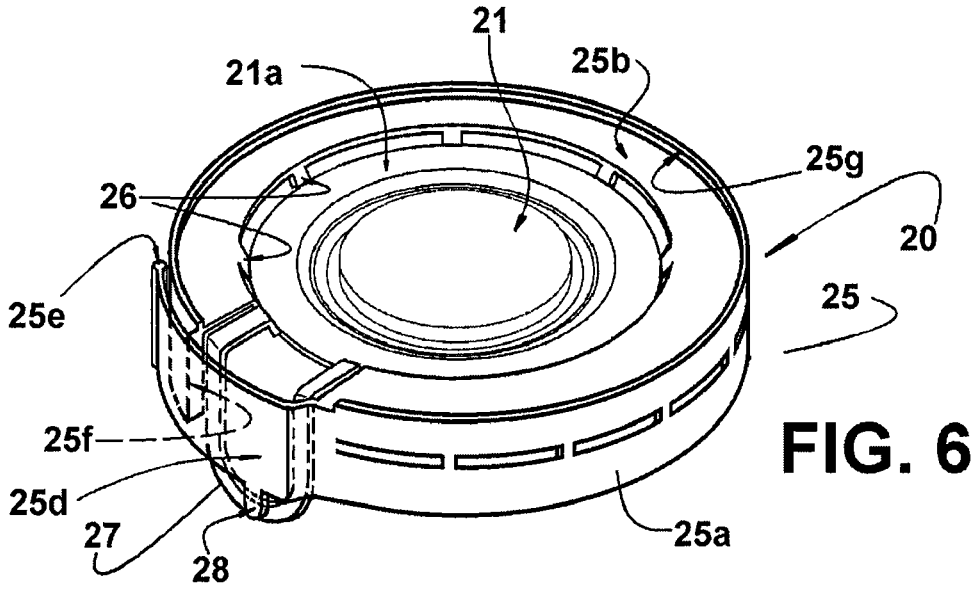
FIG. 6 is a perspective view of another construction for the plastic lid of the present invention, incorporating a seal portion.
Figure 7:
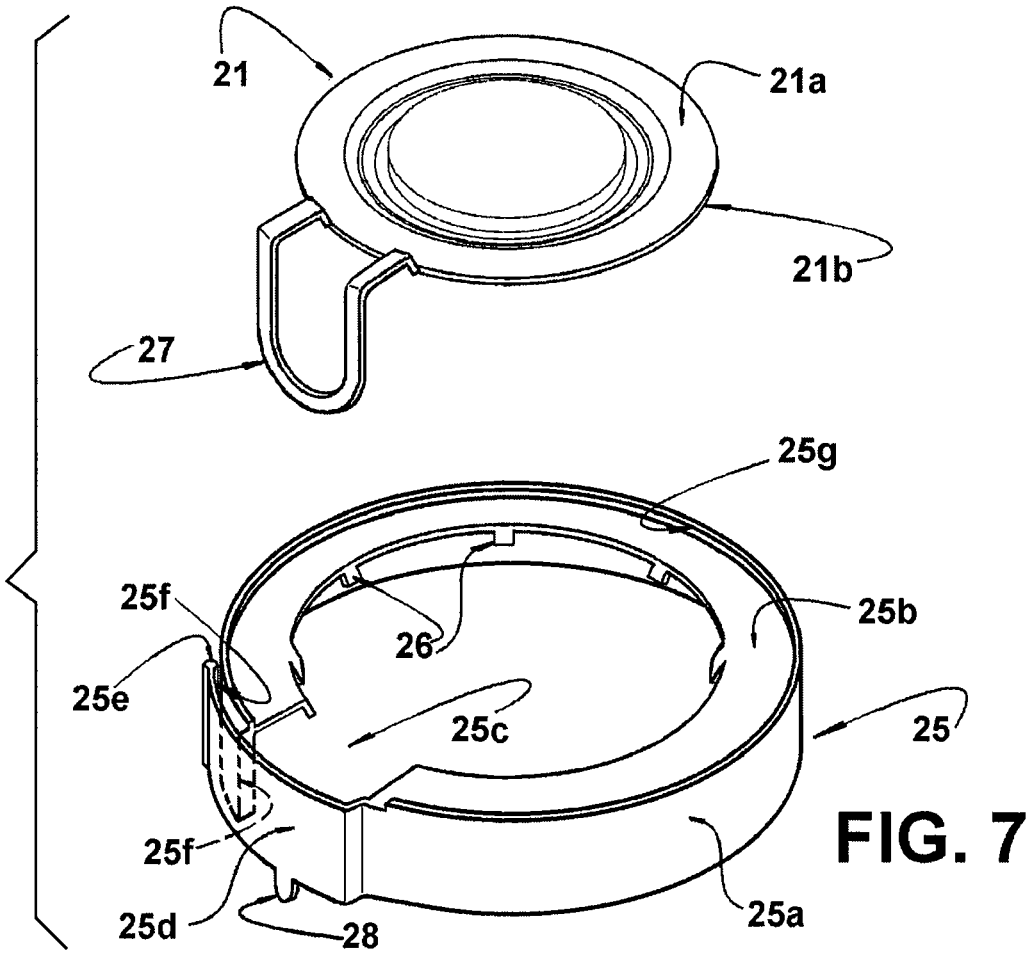
FIG. 7 is an exploded perspective view of the lid of FIG. 6, after the seal portion has been ruptured.
Figure 8:
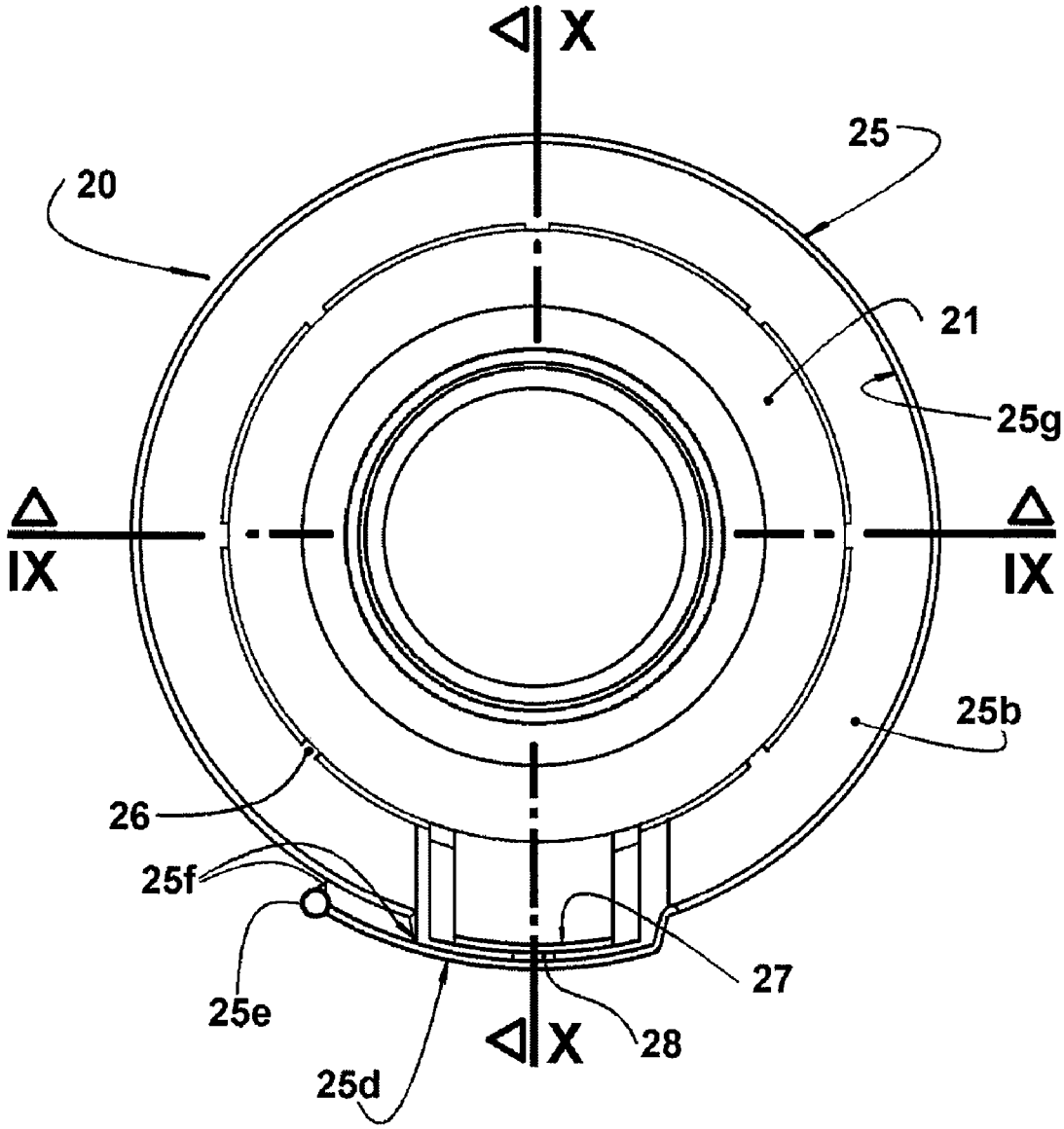
FIG. 8 is a top plan view of the plastic lid illustrated in FIG. 6.
Figure 9:
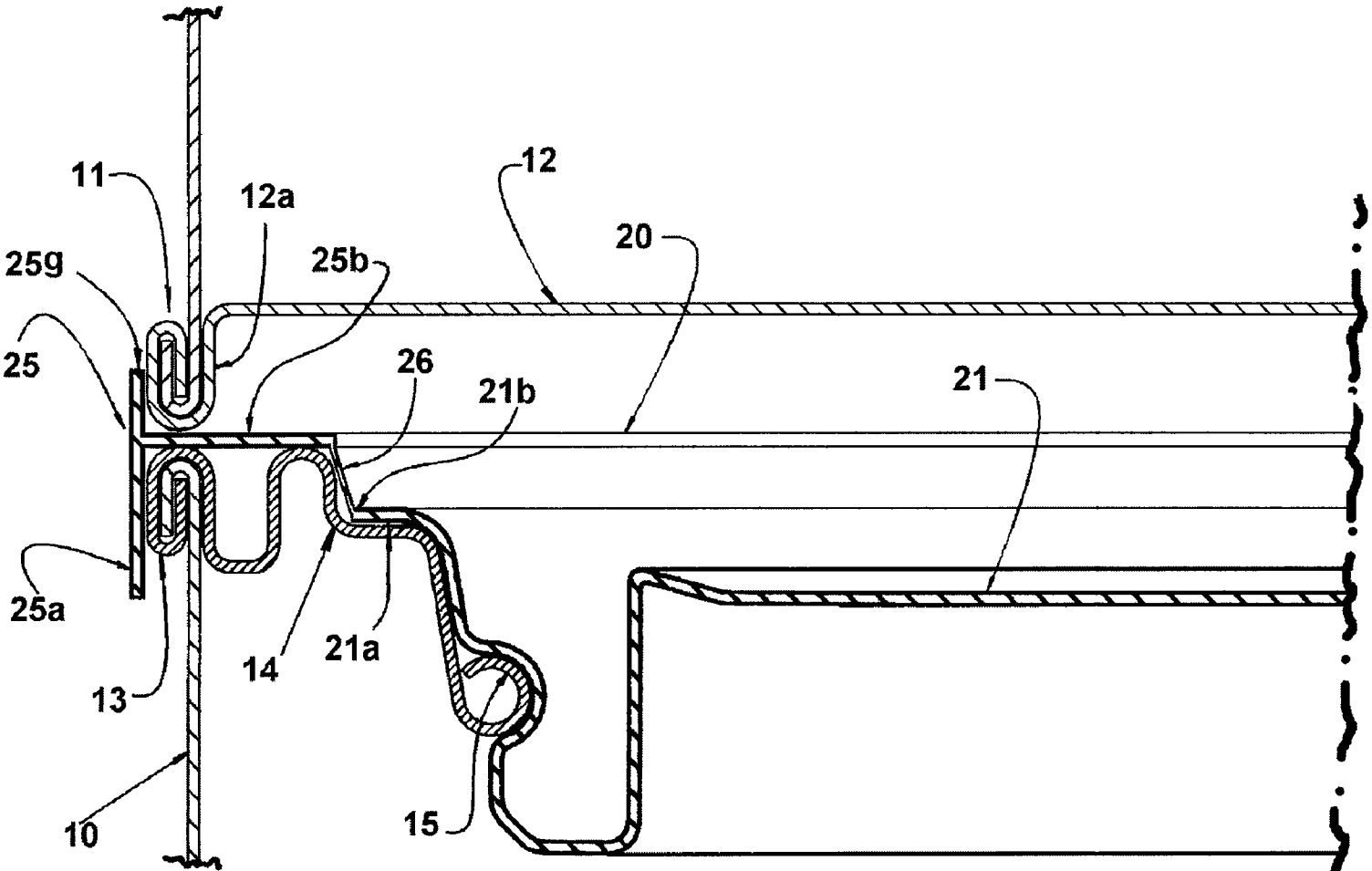
FIG. 9 is a partial diametrical cross-sectional view of the lid illustrated in FIGS. 6-8 when mounted to the upper end of a can, said view being taken according to line IX-IX of FIG. 8.
Figure 10:
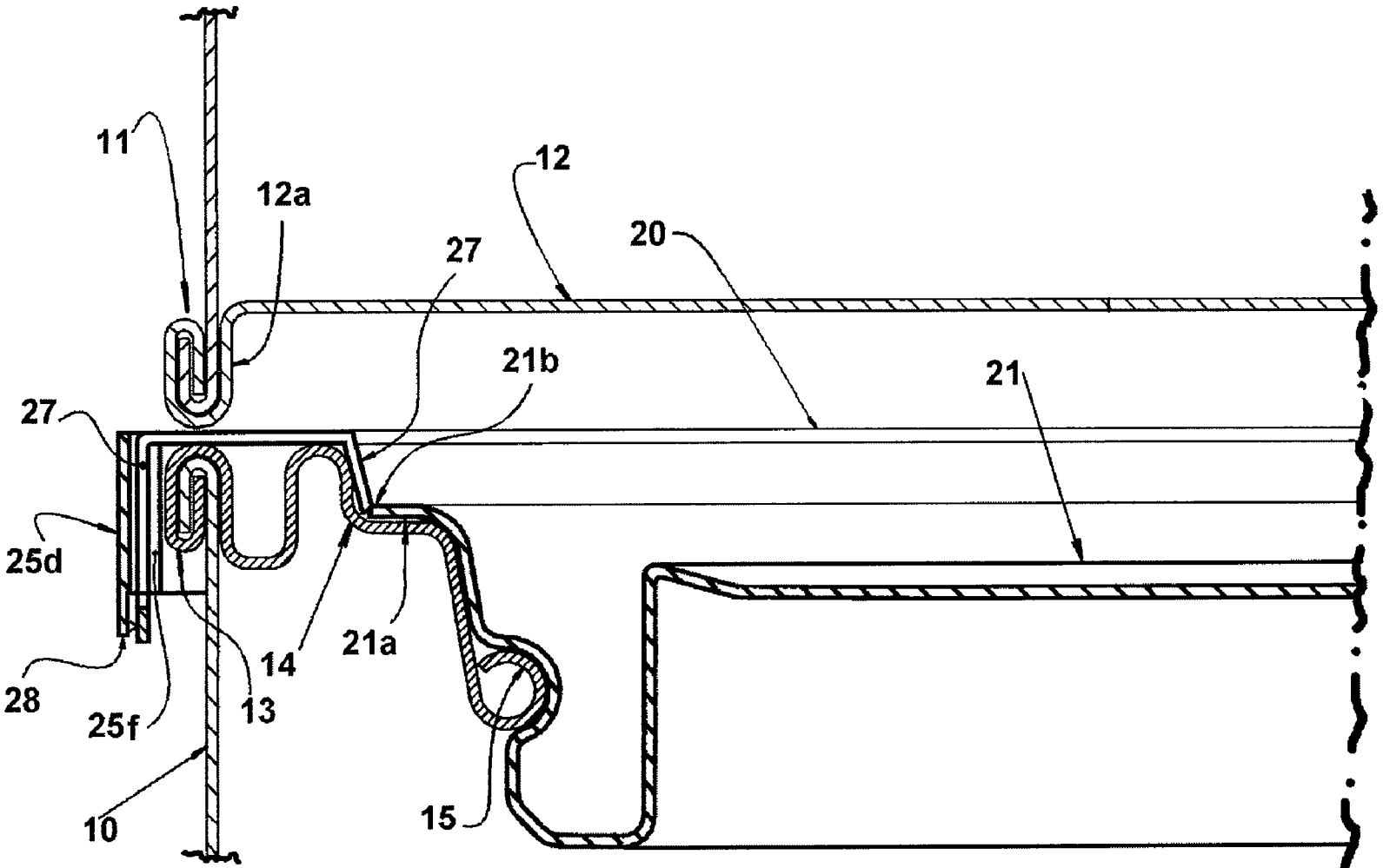
FIG. 10 is a similar view to that of FIG. 8, but taken according to line X-X in FIG. 8.

According to the embodiments illustrated in FIGS. 1-10, the present lid is applied to a can made of a metallic sheet, comprising a tubular body 10 with a lower end 11 affixing a bottom wall 12, and with an upper end 13 affixing, by double seaming, an annular upper wall 14, which defines, internally, a seat 15 for the hermetic seating of the lid 20.

The annular upper wall 14 can take the form of a structural ring, as illustrated in FIGS. 4, 5, 9, and 10, or even in the form of an annular plate in the cans with great dimensions, such as the 18-liter cans. The construction of the annular upper wall 14 and of the seat 15 may be achieved by different manners, provided that it allows a hermetic and safe fitting of the lid 20 to the upper part of the can. In FIGS. 4, 5, 9 and 10, the construction of the annular upper wall 14 and of the seat 15 is accomplished as described and claimed in the Brazilian patent PI 9408643-5 issued to the same applicant in Brazil and in other countries (such as, for example in the U.S. Pat. No. 5,899,352, and in Europe, EP0706486). Therefore, it is not necessary to include the detailed description of said prior construction in the present specification.

According to the invention and as illustrated in the appended drawings, the lid 20 is preferably constructed in plastic material, transparent or not, comprising a sealing portion 21 of adequate construction, so as to be removably seated and retained in the seat 15, said sealing portion 21 presenting an upper edge 21*b*, which in the illustrated embodiment is defined by an outer peripheral flange 21*a* superiorly incorporated to the sealing portion 21. The lid 20 further comprises, in a single piece with the sealing portion 21, a seal portion 25 having a lower skirt 25*a*, which is generally tightly seated around a circumferential extension of the upper end 13 of the tubular body 10, and an upper ring 25*b* to be seated onto a circumferential extension of the upper end of the tubular body 10. The upper ring 25*b* is incorporated, externally, to the lower skirt 25*a* and, internally and by means of manually breakable radial bridges 26, to the upper edge 21*b* of the sealing portion 21.

According to the present invention, the radial bridges 26 are broken when submitted to a certain pulling force, for separating the seal portion 25 from the sealing portion 21, upon the first opening of the lid 20.

The seal portion 25 presents an interruption 25*c*, in its circumferential extension, extending through the width of the upper ring 25*b* and through at least part of the height of the lower skirt 25*a*, said interruption 25*c* defining a certain circumferential spacing between respective confronting edges of each of said parts of upper ring 25*b* and lower skirt 25*a* in both sides of the interruption 25*c*.

According to the present invention, the sealing portion 21 incorporates a gripping tab 27 projecting radially outwardly and axially downwardly along said interruption 25*c* of the seal portion 25, for example remaining substantially leveled with the respective part of said seal portion 25.

In the embodiment illustrated in FIGS. 1-5, the gripping tab 27 projects through the whole corresponding radial extension of the upper ring 25*b* and through part of the axial extension of the lower skirt 25*a* and, in the construction illustrated in FIGS. 6-10, the gripping tab 27 occupies the whole corresponding radial extension of the upper ring 25*b* and projects axially and inferiorly beyond the axial extension of the lower skirt 25*a*.

According to the present invention, the seal portion 25 comprises at least one breakable lock 28 connecting the gripping tab 27 to at least one of the parts defined by the upper ring 25*b* and by the lower skirt 25*a* of the seal portion 25. The gripping tab 27 is manually operable only when part of the seal portion 25 is ruptured, for example when each breakable lock 28 is broken.

In the construction illustrated in FIGS. 1-5, the gripping tab 27 is laterally incorporated to the upper ring 25*b* by means of a breakable lock 28 in the form of two or more circumferential bridges, which are manually broken upon the first opening of the lid 20.

In the construction proposed by the present invention and illustrated in FIGS. 1-5, the radial bridges 26 and the breakable locks 28 are broken, allowing separating the sealing portion 21 from the seal portion 25 upon the first opening of the lid by the user manually raising the gripping tab 27.

In the construction illustrated in FIGS. 6-10, the lower skirt 25*a* incorporates the ends of a seal bridge 25*d* circumferentially extended over the interruption 25*c* of the seal portion 25 and over the gripping tab 27. The seal bridge 25*d* presents a first end 25*e*, which is incorporated to the lower skirt 25*a* by connecting means 25*f* to be ruptured when said first end 25*e* is forced away from the lower skirt 25*a*, for example being radially pulled outwardly, so as to release the manual access to the gripping tab 27. In the illustrated embodiment, the seal bridge 25*d* has its first end 25*e* disposed over the lower skirt 25*a*, being incorporated to the latter by two connecting means 25*f* circumferentially spaced from each other.

In the construction illustrated in FIGS. 6-10, the gripping tab 27 is inferiorly incorporated to the seal bridge 25*d* through a breakable lock 28 in the form of one or more axial bridges that are manually broken upon the first opening of the lid.

The provision of the gripping tab 27 allows the sealing portion 21 to be easily removed from its seating position in the seat 15 and also a controlled and progressive opening of the can, first in the region adjacent to the gripping tab 27 and, subsequently, in the remaining portion of the seat, preventing the stored product from being inadvertently taken out from the can.

According to the present invention, the gripping tab 27 can be massive and at least partially hollow, defining a handle, as illustrated in FIGS. 6-10.

In the construction illustrated in FIGS. 1-3, and 5, the gripping tab 27 is massive, formed of respective portions of the upper ring 25*b* and of the lower skirt 25*a*, remaining substantially leveled with said parts of the sealing portion 21 and maintaining from said parts a gap 29 along the whole extension thereof.

As illustrated in FIGS. 1-3, and 5, the gripping tab 27 is preferably defined in a rupture portion 24 of the lower skirt 25*a* that is maintained separated from the remaining portion of the lower skirt 25*a* and only superiorly incorporated to the upper ring 25*b*. With this construction, the rupture portion 24 of the lower skirt 25*a* can be a "U" shaped strip, maintaining said gap 29 around the respective extension of the gripping tab 27 and separated from the remaining portion of the lower skirt 25*a* by a pair of axial cuts 23, which in the illustrated example extend radially inwardly by a certain extension of the width of the upper ring 25*b*, for allowing, after the first opening of the lid, the seal portion 25 to be ruptured in the region of the rupture portion 24 and completely and easily separated from the tubular body 10.

In a constructive form, the upper ring 25*b* may incorporate an upper circumferential rib 25*g*, which is continuous or defined in segments, projecting over the upper end 13 of the tubular body 10, in order to fit loosely and telescopically, and externally or internally, in the lower end 11 of another tubular body 10 stacked over the first one.

In case the upper circumferential rib 25*g* presents a diameter smaller than that of the lower end 11 of the tubular body 10, it is fitted in a circumferential recess 12*a* provided on the bottom wall 12, internally to the lower end 11 of another tubular body stacked over the first one.

In the construction of the lid 20, as illustrated in FIGS. 1-5, the upper edge 21*b* of the sealing portion 21 is provided in a plane substantially coinciding with a plane containing the upper ring 25*b*, the radial bridges 26 in this construction being provided substantially horizontal and leveled with said parts.

In the construction illustrated in FIGS. 6-10, the upper edge 21*b* of the sealing portion 21 is provided in a lower plane in relation to that containing the upper ring 25*b* and the radial bridges 26 are substantially vertically provided between said parts.

While the invention has been described in relation to two possible can embodiments presenting only one constructive form, it should be understood that alterations can be made, without departing from the protective scope defined by the claims of the present patent application.

The invention claimed is:

1. A closure assembly comprising:

a lid; and a can comprising:

a tubular body having a lower end and an upper end; and an annular upper wall which defines, internally, a seat for the hermetic seating of the lid, the lid comprising:

a sealing portion, which is removably seated and retained in the seat and which is provided with an upper edge defined by an outer peripheral flange superiorly incorporated to the sealing portion; and a seal portion having a lower skirt seated around part of the upper end of the tubular body, and an upper ring seated onto a circumferential extension of the upper end of the tubular body and being incorporated, externally, to the lower skirt and, internally and through radial bridges, to the upper edge of the sealing portion, the upper ring being provided in a plane which is substantially parallel to a plane defined by the upper edge, the seal portion presenting, in its circumferential extension, an interruption extending through a width of the upper ring and through at least part of a height of the lower skirt, the interruption defining a certain circumferential spacing between respective confronting edges of each of the upper ring and the lower skirt, wherein the sealing portion incorporates a gripping tab projecting radially outwardly and axially downwardly through said interruption of the seal portion, said gripping tab being manually operable only when part of the seal portion is ruptured, said radial bridges being ruptured when submitted to a certain pulling force to separate the seal portion from the sealing portion, when the lid is opened for the first time, and wherein the seal portion incorporates a first and a second axial cut, each extending through at least the height of the lower skirt and defining a rupture portion of the lower skirt that is superiorly incorporated to the upper ring, and wherein each of the first and the second axial cuts define a spacing between respective confronting edges of the rupture portion of the lower skirt and a remaining portion of the lower skirt, and wherein the gripping tab is defined in a the rupture portion of the lower skirt , and wherein the rupture portion of the lower skirt is adapted to be ruptured after the sealing portion is separated from the seal portion when the lid is opened for the first time, such that the seal portion is completely removable from the tubular body.

2. The closure assembly according to claim 1, wherein the gripping tab is substantially leveled with the upper ring and with the lower skirt, maintaining with said parts a gap along the whole extension thereof.

3. The closure assembly, according to claim 1, wherein the gripping tab is at least partially hollow, in order to define a handle.

4. The closure assembly, according to claim 3, wherein the gripping tab is axially and inferiorly extended beyond the lower skirt.

5. The closure assembly according to claim 1, wherein the gripping tab is solid.

6. The closure assembly according to claim 1, wherein the lower skirt is tightly seated around the circumferential extension of the upper end of the tubular body.

7. The closure assembly, according to claim 6, wherein the lower skirt incorporates the ends of a seal bridge, circumferentially extended over the interruption of the seal portion and over the gripping tab, a first end of said ends of the seal bridge being incorporated to the lower skirt by connecting means to be ruptured when said first end is forced away from the lower skirt, in order to liberate the manual access to the gripping tab.

8. The closure assembly, according to claim 7, wherein the seal bridge has its first end disposed over the lower skirt and incorporated to the lower skirt by two connecting means that are circumferentially spaced from each other.

9. The closure assembly according to claim 6, wherein the seal portion comprises at least one breakable lock connecting the gripping tab to at least one of the parts defined by the upper ring and by the lower skirt of the seal portion.

10. The closure assembly according to claim 1, wherein the upper ring incorporates an upper circumferential rib projecting over the upper end of the tubular body, in order to fit loosely and telescopically in the lower end of another tubular body stacked over the first one.

11. The closure assembly according to claim 10, wherein the upper circumferential rib is continuous.

12. The closure assembly according to claim 10, wherein the upper circumferential rib fits around the lower end of said other tubular body stacked over the first one.

13. The closure assembly according to claim 10, wherein the upper circumferential rib fits in the interior of a circumferential recess provided internal to the lower end of said other tubular body stacked over the first one.

14. A closure assembly comprising:

a lid; and a can comprising a tubular body having a lower end and an upper end carrying a seat for the hermetic seating of the lid, the lid comprising:

a sealing portion, which is removably seated and retained in the seat and provided with an upper edge projecting radially outwardly from the seat; and a seal portion having a lower skirt seated around part of the upper end of the tubular body, and an upper ring seated on part of the upper end of the tubular body and being incorporated, externally, to the lower skirt and, internally and through radial bridges, to the upper edge of the sealing portion, the seal portion presenting, in its circumferential extension, an interruption extending through a width of the upper ring and through at least part of a height of the lower skirt, wherein the sealing portion incorporates a solid gripping tab projecting radially outwardly and axially downwardly through said interruption of the seal portion, the gripping tab being manually operable only when part of the seal portion is ruptured, said radial bridges being ruptured when submitted to a certain pulling force to separate the seal portion from the sealing portion, when the lid is opened for the first time, and wherein the seal portion incorporates a first and a second axial cut, each extending through at least the height of the lower skirt and defining a rupture portion of the lower skirt that is superiorly incorporated to the upper ring, and wherein each of the first and the second axial cuts define a spacing between respective confronting edges of the rupture portion of the lower skirt and a remaining portion of the lower skirt, and wherein the gripping tab is defined in a the rupture portion of the lower skirt , and wherein the rupture portion of the lower skirt is adapted to be ruptured after the sealing portion is separated from the seal portion when the lid is opened for the first time, such that the seal portion is completely removable from the tubular body.

15. The closure assembly according to claim 14, wherein the rupture portion of the lower skirt is defined by a "U" shaped strip maintaining a gap around a respective extension of the gripping tab, separating it from the rupture portion.

16. The closure assembly according to claim 15, wherein the axial cuts extend radially inwardly through a certain extension of the width of the upper ring.

17. A lid comprising:

a sealing portion, which is provided with an upper edge defined by an outer peripheral flange superiorly incorporated to the sealing portion; and a seal portion having a lower skirt and an upper ring being incorporated, externally, to the lower skirt and, internally and through radial bridges, to the upper edge of the sealing portion, the upper ring being provided in a plane which is substantially parallel to a plane defined by the upper edge, the seal portion presenting, in its circumferential extension, an interruption extending through a width of the upper ring and through at least part of a height of the lower skirt, the interruption defining a certain circumferential spacing between respective confronting edges of each of the upper ring and the lower skirt, wherein the sealing portion incorporates a gripping tab projecting radially outwardly and axially downwardly through said interruption of the seal portion, said gripping tab being manually operable only when part of the seal portion is ruptured, said radial bridges being ruptured when submitted to a certain pulling force to separate the seal portion from the sealing portion, when the lid is opened for the first time, and wherein the seal portion incorporates a first and a second axial cut, each extending through at least the height of the lower skirt and defining a rupture portion of the lower skirt that is superiorly incorporated to the upper ring, and wherein each of the first and the second axial cuts define a spacing between respective confronting edges of the rupture portion of the lower skirt and a remaining portion of the lower skirt, and wherein the gripping tab is defined in the rupture portion of the lower skirt; and wherein the rupture portion of the lower skirt is adapted to be ruptured after the sealing portion is separated from the seal portion when the lid is opened for the first time, such that the seal portion is completely removable from the tubular body, and wherein, for the purpose of forming a closure assembly comprising the lid and a tubular body, the lower skirt is adapted to be seated around part of an upper end of the tubular body, the upper ring is adapted to be seated onto a circumferential extension of the upper end of the tubular body, and the sealing portion is adapted to be removably seated in a seat defined by an annular upper wall that is internal to the tubular body.

* * * * *